US005779086A

United States Patent [19]

Barrash

[11] Patent Number: 5,779,086

[45] Date of Patent: Jul. 14, 1998

[54] SEALING SYSTEM AND METHOD FOR A TWIST-OFF CAN END ASSEMBLY

[75] Inventor: Marshall J. Barrash, Atlanta, Ga.

[73] Assignee: The Coca-Cola Company, Atlanta, Ga.

[21] Appl. No.: 505,881

[22] Filed: Jul. 24, 1995

[51] Int. Cl.[6] ..... B65D 51/22

[52] U.S. Cl. ..... 220/240; 215/252

[58] Field of Search ..... 220/240, 255, 220/319, 256, 257, 265, 266, 269, 270, 359, 288, 296, 301, 906, 212, 646, 648, 634; 215/228, 252, 306, 271, 232, 901, 254, 270, 273, 274, 275

[56] References Cited

U.S. PATENT DOCUMENTS

| | | | |
|---|---|---|---|
| 3,343,712 | 9/1967 | Lentz | 220/240 |
| 4,771,905 | 9/1988 | Perne et al. | 215/240 |
| 4,805,792 | 2/1989 | Lecinski et al. | 215/252 X |
| 5,273,182 | 12/1993 | Laybourne | 220/212 X |
| 5,452,818 | 9/1995 | Yost | 220/240 X |
| 5,458,252 | 10/1995 | Logel | 220/240 X |

*Primary Examiner*—Jospeh M. Moy

*Attorney, Agent, or Firm*—Birch, Stewart, Kolasch & Birch, LLP

[57] ABSTRACT

A twist-off can end assembly has a cylindrical can body and a lid assembly. The lid assembly includes a joined lid and collar. When an open end of the can body is closed by the lid assembly, a sealing lip on the collar engages a flange on the can body to form a hermetic seal. An annular chamber adjacent the sealing lip is formed by the collar and flange. When pressure of the contents within the can body increase to a predetermined amount, gas escapes from the can interior to the annular chamber. When pressure within this annular chamber increases, the lip deforms to increase the seal between the lid assembly and can body. Therefore, a self-sealing can arrangement is obtained. The lid assembly can be readily unscrewed from the can body.

46 Claims, 5 Drawing Sheets

SEALING SYSTEM AND METHOD FOR A TWIST-OFF CAN END ASSEMBLY

BACKGROUND OF THE INVENTION

1. Field of the Invention

The present invention relates to a twist-on/twist-off, resealable assembly for a can-end with a hermetic seal. In particular, the invention relates to a sealing member for a can body which uses pressure generated from the can's contents to increase the hermetic seal. The present invention is also directed to a method for applying the resealable assembly to an open end of the can body.

2. Background of the Invention

Current can ends for beverage cans are generally of the "ring-pull" or "press-down-stay-on-tab" type and have some disadvantages. Generally, the cans known in the art are not resealable. The tabs can be difficult to open and the opening size/shape is not ideal for drinking.

Beverage containers which are resealable often do not have adequate seals, especially for carbonated beverages. In particular, gases escaping from such carbonated beverages can easily leak past seals of existing reusable containers.

Finally, designs of can-ends which enable easy inclusion of a hidden gift, or other promotional material, which is only accessible when the can is opened, would give significant promotional advantages in the market-place compared with current can ends.

SUMMARY OF THE INVENTION

Accordingly, it is an object of the present invention to provide a sealing system for a wide-mouth can which is reclosable, easy-open and easy-drink.

A further object of the present invention is to provide for a sealing system for cans which provides for automatic sealing in response to increases in pressure due to an increase in pressure of the contents within the can body.

A further object of the present invention is to provide a sealing system and method which is easy for both the manufacturer and consumer to seal and/or reseal the container.

An additional object of the present invention is to provide a sealing system which enables hidden-gift promotional possibilities.

A further object of the present invention is to provide for a sealable can which has dimensions similar to current standard cans so as to be readily dispensable from existing vending machines and to have the same storage requirements as existing cans. Such a can should minimize revisions to existing can stocks and manufacturing techniques.

A further object of the present invention is to provide tamper evidence features for the sealing system and method.

Another object of the present invention is to encourage reduction of litter. To this end, it is an object of the present invention to enable the removable lid assembly to be used as a coaster.

As an alternative approach to reducing litter, it is an object of the present invention to provide a tether incorporated in the tamper evident features to thereby keep a removed lid connected to the can body.

A further object of the present invention is to provide an inexpensive, strong and reliable sealing system and method.

These and other objects of the present invention are fulfilled by providing a twist-off can end assembly comprising a cylindrical can body and a lid assembly. The can body has an open end and a closed end. A flange extends around the open end of the can body. The lid assembly of the present twist-off can end assembly has a lid and a collar. The lid is adjacent the flange when the open end of the can body is closed by the lid assembly. The collar is attached to the lid. Means for sealing the lid assembly to the can body are provided on the collar. This means for sealing comprises a deformable sealing lip which engages the can body to form a hermetic seal when the lid assembly is placed on the can body. An annular chamber is defined between the collar and the can body. Pressure within the annular chamber will increase due to increases in pressure of the contents within the can body. Such an increase in pressure will cause the lip to deform and thereby increase the hermetic seal between the lip assembly and the can body.

These and other objects of the present invention are also fulfilled by a sealing member mountable on a can body in order to close an opening in the can body. A lid and collar are provided. The collar is attached to the lid and defines a portion of a chamber. This chamber will receive escaping gas from the can. A sealing lip is provided on the collar to form a hermetic seal with the can body. The lip is a sealing means which will increase the seal in response to increases in pressure in the chamber.

These and other objects of the present invention are also fulfilled by a method for sealing an open end of a can body with a lid assembly. The can body has a closed end opposite the open end. A flange extends around the open end of the can body. The lid assembly has a collar hermetically mounted on a lid. A sealing lip is provided on the collar. The method includes the steps of placing the lid assembly over the open of the can body and engaging the lid and sealing lip with the flange. A hermetic seal is formed between the sealing lip and the flange. The method further comprises the step of providing an annular chamber defined by the collar and the flange. This chamber is adjacent the sealing lip. Gas escaping from the interior of the can body is received in the annular chamber. Pressure within the annular chamber increases as gas is received therein. Such an increase in pressure will deform the sealing lip in order to increase the hermetic seal between the sealing lip and the flange.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
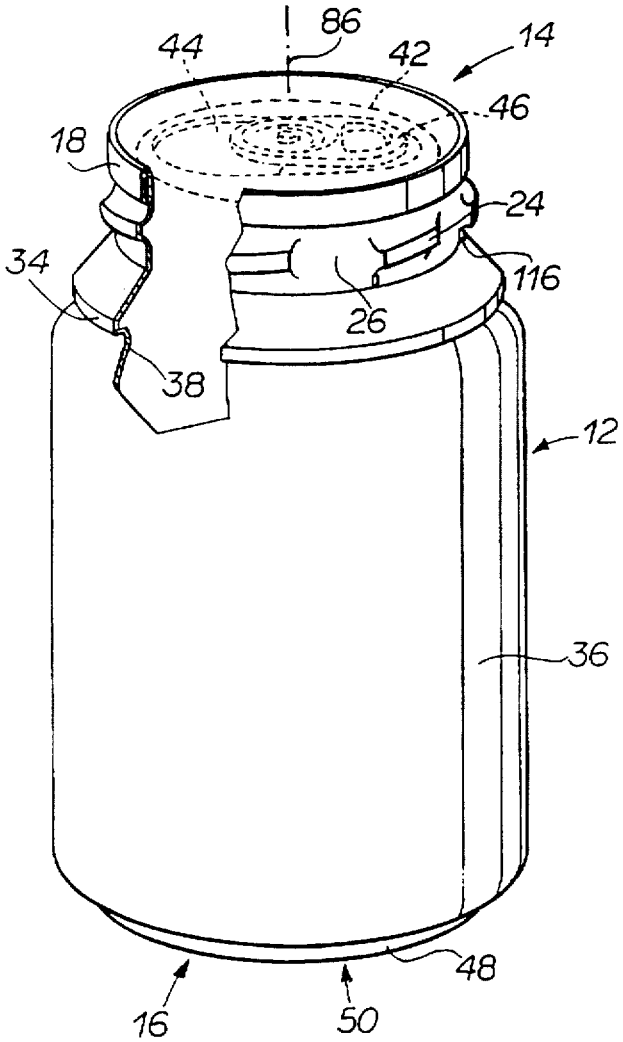
FIG. 1 is a perspective view of a can body for a first embodiment of the sealing system of the present invention.

Referring in general to the drawings and with particular reference to FIGS. 1 and 3, a sealing system 10 of the present invention will now be described. This sealing system is used on wide-mouth can bodies 12. While a particular can body 12 has been indicated in the present invention, it should be noted that many different types of cans can be used. The can body 12 has an open end 14 and a closed end 16. A flange 18 extends around the open end of the can body.

Figure 3:
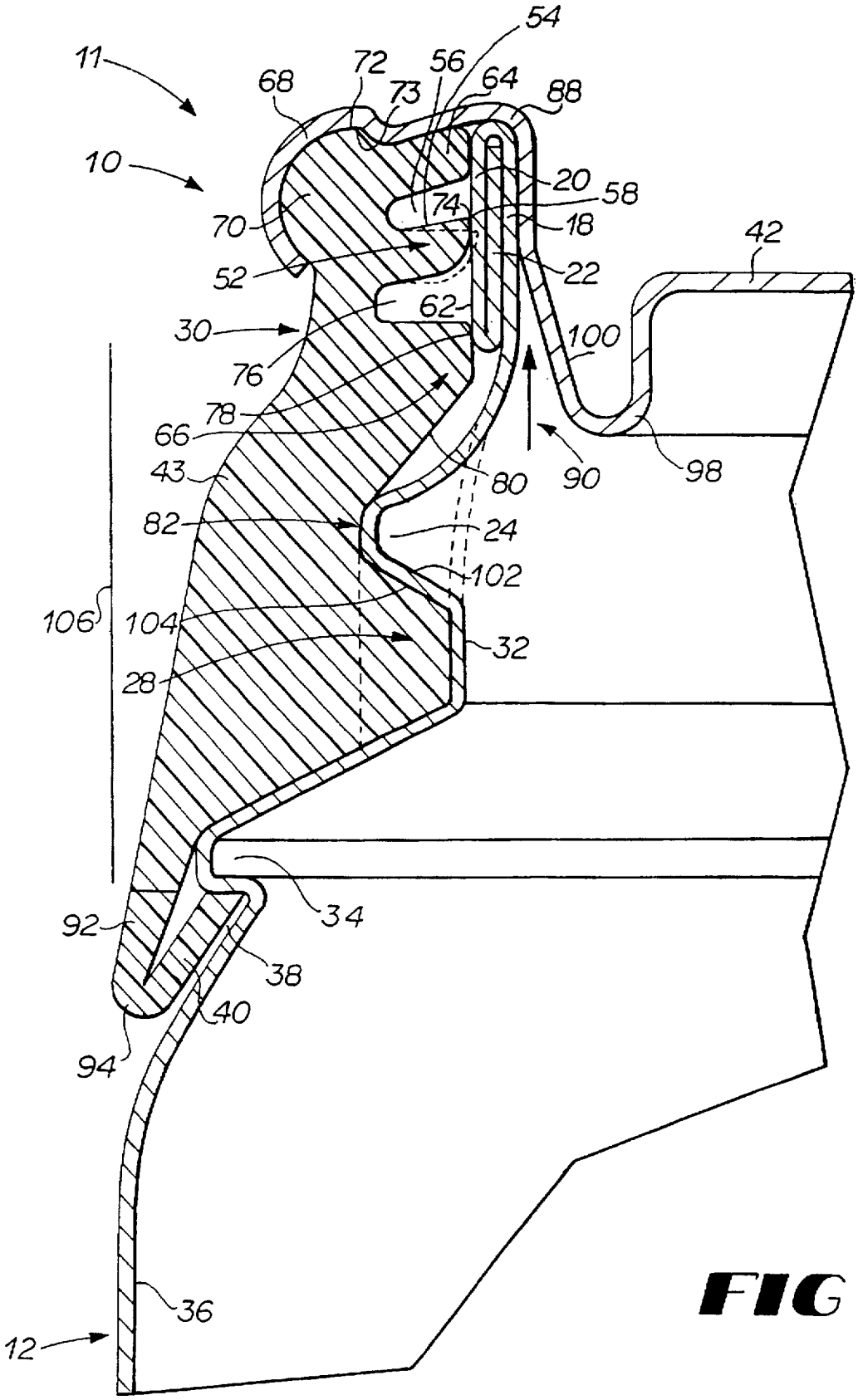
FIG. 3 is a sectional side view of the first embodiment of the sealing system of the present invention.

In the embodiment shown in FIGS. 1 and 3, the flange 18 is a rolled flange. The flange includes an outermost downwardly extending portion 20 and an upwardly extending portion 22. The portions 20 and 22 are in engagement with one another. It should be appreciated that other flange arrangements can be used.

For example, the flange 18 is shown as having an upwardly extending portion 22 and a downwardly extending portion 20. It is contemplated that a single roll could be used for such a flange. In other words, only a downwardly extending portion 20 would be provided. Alternatively, this flange can be rolled any number of times or it could be unbent. The rolling of the flange 18 merely aids in stiffening of the open end 14 of the can body 12. In fact, as will be described below, the second embodiment of the present invention has a different flange design 18' than that of the first embodiment flange 18. The rolled flange 18 of the first embodiment has an ironed outside surface of a precise diameter. This sizing will aid in insertion of the lid assembly 30 onto the can body 12.

In FIG. 3, beneath flange 18, a plurality of lugs 24 are provided. As shown in FIG. 1, these lugs 24 have a slight slope. Openings 26 are provided between the lugs. These lugs 24 interlock with fingers 28 on lid assembly 30 as will be described below. While a plurality of lugs 24 are shown, it should be appreciated that any number of lugs can be used. Alternatively, a single lug could be used. For each of the lugs 24, a corresponding finger 28 is provided on the collars of the lid assemblies 30. Alternatively, threads could be used.

On the can body beneath lugs 24, indentation 32 is provided. This indentation 32 will receive the fingers 28 of the lid assembly 30 as will be described below.

As seen in FIG. 3, a ring receiving ridge 34 is provided beneath the indentation 32 on the can body 12. Formed between the ridge 34 and the main portion 36 of the can body 12 is a ring receiving recess 38. A tamper evident ring 40 of the lid assembly 30 is received by this ridge 34 and recess 38 as will be described below.

Turning to FIG. 1, a portion of the lid assembly 30 is shown in broken lines. In particular, the lid 42 of the assembly is shown. This lid 42 includes an opening 44 for dispensing the contents of the can 12. A conventional tab 46 is shown for the opening 44. This tab 46 is a "press-down-stay-on-tab". It should be appreciated that a "ring-pull" tab could be utilized with the sealing system 10 of the present invention. Alternatively, other types of easy-open resealable can ends can be used inclusive of those having pop-out-spouts. Alternatively, a lid 42 with no opening therein could also be used.

On the closed end 16 at the bottom of the can body 12, a ridge 48 is provided. This ridge 48 acts as a receptacle 50 for receiving the lid assembly 30 or 30' when it is removed from the can body 12 as will be described below.

Figure 2:
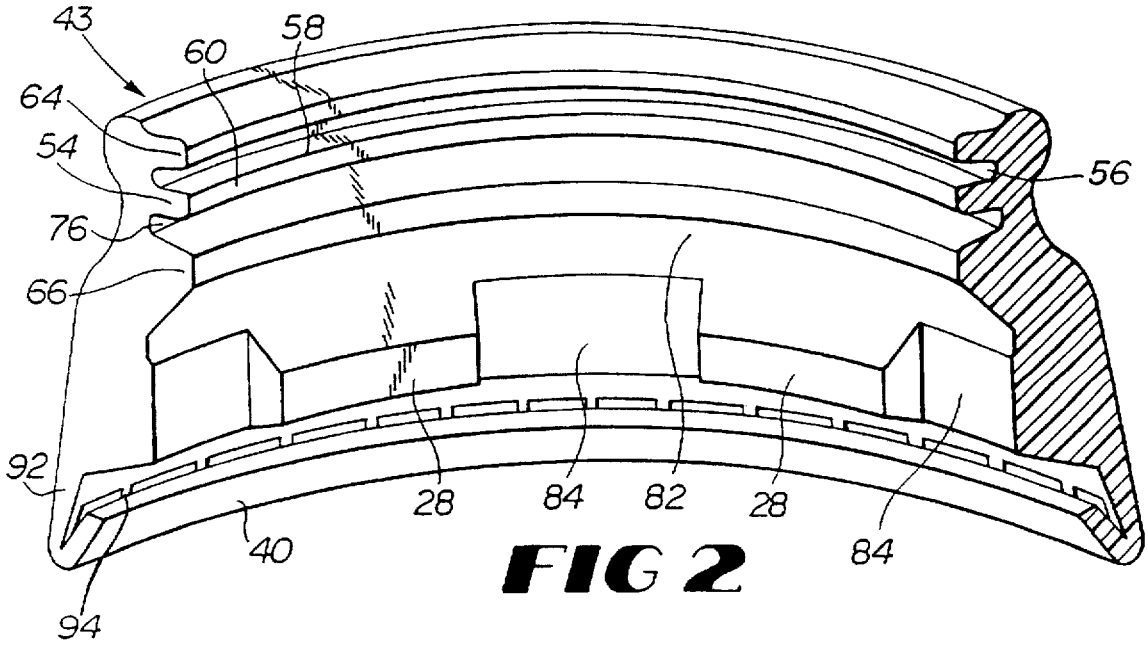
FIG. 2 is a sectional perspective view of the collar used with the first embodiment of the sealing system of the present invention.

Turning now to FIGS. 2 and 3, the lid assembly 30 of the first embodiment will be described in more detail. The lid assembly 30 is formed by lid 42 and collar 43. It is contemplated that the lid 42 will be made from metal while the collar 43 will be plastic. These two members are bonded together to form a unitary structure. The lid 42 and collar 43 will be removable as a unit from the end of the can body 12 as will be described below.

This lid assembly 30 includes means for sealing 52. The means for sealing 52 comprises a deformable sealing lip 54 engagable with the flange 18 of the can body 12. It should be noted that the lid assembly 30' of the second embodiment has a similar sealing lip 54 which is engagable with the flange 18' as will be described in more detail below.

An annular chamber 56 is provided adjacent the deformable lip 54. As seen in FIG. 2, this deformable lip 54 has a sealing tip 58 with a given circumference 60. When the lid assembly 30 is placed on the open end 14 of the can body 12, the sealing lip 54 will be deformed. This position is indicated in solid lines in FIG. 3. Before the lid assembly 30 is placed on the can body 12, the sealing lip 54 will have an undeformed orientation as indicated in dotted lines in FIG. 3. In this undeformed orientation, the tip 58 of the lip 54 will have a given circumference 60. The flange 18 has a given outer circumference 62. The circumference 60 of the undeformed sealing tip 58 is less than the circumference 62 of flange 18. It should therefore be readily apparent that when the lid assembly 30 is placed on the end of the can body 12, it will be necessary for the sealing lip 54 to be deformed.

The lid assembly 30 of the first embodiment also includes an axially outer protrusion 64 and an axially inner protrusion 66. The sealing lip 54 is positioned between these protrusions 64,66. The annular chamber 56 is formed by the axially outer protrusions 64, the sealing lip 54 and the downward extending portion 20 of flange 18.

The axially outer protrusion 64 is adjacent to flange 18 when the lid assembly 30 is mounted on the can body 12. A lid 42 is adjacent to and mounted on the outer protrusion 64. Adhesive 73 can be used to bond the lid 42 to the collar 43. Also, the outer portion 68 of the lid is crimped around the upper portion 70 of the collar. The crimping and/or adhesive 73 will form a hermetic seal 72 between the lid 42 and the collar 43. It is contemplated that the collar 43 will remain mounted to the lid 42 when the lid assembly 30 is removed from the can body 12 as will be described below.

Apart from the hermetic seal 72 between the collar 43 and lid 42, a second hermetic seal 74 is also formed by the means for sealing 52. In particular, the hermetic seal 74 is formed between sealing lip 54 and flange 18. When the lid assembly 30 is removed from the can body 12, this hermetic seal 74 will be broken as will be described below.

The collar 43 of the lid assembly 30 has an annular groove 76 provided beneath sealing lip 54. Both the annular chamber 56 and annular groove 76 encircle the open end 14 of the can body 12 when the lid assembly 30 is mounted thereon. The annular groove 76 is defined, in part, by the axially inner protrusion 66.

This axially inner protrusion 66 has a radially inner, flat edge 78 which engages with flange 18 when the lid assembly 30 is mounted on the can body 12. This flat edge assembly helps to strengthen and stiffen the can body 12. This flat edge 78 will follow distortions of the flange 18 in order to assure product integrity.

A tapered surface 80 is below flat edge 78 on inner protrusion 66. This tapered surface 80 aids in aligning of the lid assembly 30 during mounting on body 12 without damaging the sealing lip 54. Beneath tapered surface 80, a lug receiving recess 82 is provided. This recess 82 will receive the lugs 24 on the can body 12 during insertion of the lid assembly 30 on can body 12.

Beneath the recess 82 on collar 43, the fingers 28 will be provided. Openings 84 are provided between the plurality of fingers 28 as seen in FIG. 2. When the lid assembly 30 is inserted on the can body 12, it will first be fitted onto the can body 12 along the longitudinal axis 86 thereof. The openings 84 will allow the lugs 24 to slip past the fingers 28. Likewise, the openings 26 between the lugs 24 will enable the fingers 28 to slide into position. After the lid assembly 30 is pushed onto the can body 12 by this longitudinal movement, the lid assembly 30 will then be rotated or twisted about longitudinal axis 86. Due to the corresponding or matching configuration between the lugs 24 and the fingers 28, the lid assembly 30 will be screwed onto the can body 12. Mating surfaces 102 on lugs 24 will slide along mating surfaces 104 on fingers 28 during this twisting movement. Optional detents 116 shown in FIG. 1, can be provided beneath lugs 24 to engage the sides of fingers 28 to ensure that rotation of the lid assembly 30 stops.

A relatively tight seal is formed in the area 88 between the flange 18 and the lid 42 as seen in FIG. 3. However, it is contemplated that some gas can escape from the interior of can 12 as indicated by arrow 90. This gas can leak through area 88 if pressure of the contents of the can reaches a predetermined limit.

The axially outer protrusion 64 engaging lug 18 can prevent escape of some of this gas. However, if the pressure of the contents within the can body 12 increases to a predetermined pressure, then gas can leak through areas 88 and past axially outer protrusion 64 to flange 18. The hermetic seal 72 formed by the adhesive and/or crimping between the collar 43 and lid 42 will prevent gas from leaking between the collar and lid.

When the predetermined pressure is reached within the can 12, gas will eventually escape to the annular chamber 56. As pressure within the annular chamber 56 increases, the means for sealing 52 will prevent escape of gas.

In particular, increased pressure in the annular chamber 56 will cause deformation of sealing lip 54. When the pressure within chamber 56 increases, the deformation of the sealing lip 54 will increase. As the sealing lip further deforms, the seal formed by this lip 54 and the flange 18 is increased. Therefore, very high pressures can be maintained within can body 12. Gas leakage in the instant sealing system 10 is avoided.

As the sealing lip 54 deforms, the size of the annular chamber 56 will increase while the size of annular groove 76 will slightly decrease. Because this groove 76 is provided, the lip 54 is unhindered in its deformation. The larger circumference 62 of the flange as compared to the undeformed circumference 60 of the sealing tip prevents the lip 54 from being deformed beyond a certain position whereat the hermetic seal 74 would be broken. Of course, if tremendous pressure occurs within can 12, this seal cannot be maintained. It is contemplated, however, that normal pressure obtained from a carbonated beverage in the can body 12 can easily be accommodated with the sealing system 10 of the present invention.

Apart from the sealing means 52, the collar 43 has a tamper resistant or pilfer-proof feature. Depending peripheral skirt 92 is provided on collar 43. Tamper evident ring 40 is attached to the skirt 92 by bridges 94. While FIG. 2 indicates a plurality of bridges around the circumference of skirt 92, it is contemplated that a continuous bridge can be used. It is merely necessary that a frangible area be provided such that the skirt 92 can be separated from the tamper evident ring 40.

When it is desired to remove the lid assembly 30 from the can body 12, the consumer will unscrew the lid assembly 30 by rotating it about the longitudinal axis 86. Only a slight rotation is necessary. The lid assembly 30 can then be pulled from the can. The fingers 28 and lugs 24 will move through openings 26 and 84, respectively. During the twisting or pulling of the lid assembly 30, the bridges 94 will be broken. The tamper evident ring 40 will remain on the can body 12 while the lid 42 and collar 43 will be removed therefrom.

Accordingly, when the can body 12 is opened by removing the lid assembly 30, only two separate items are obtained. By reducing the number of separate parts, the potential amount of litter is reduced in the instant system.

Figure 6:
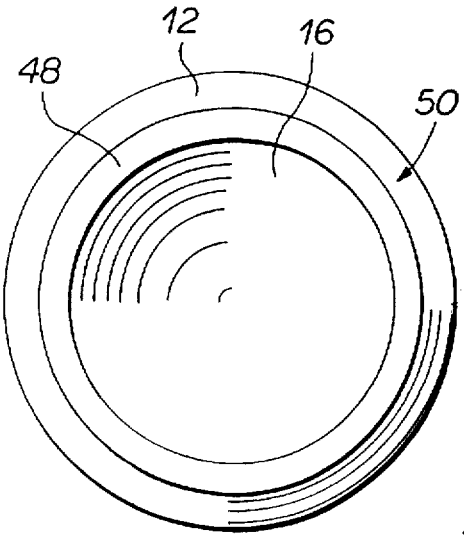
FIG. 6 is a bottom view of a can body used in the present invention.
Figure 7:
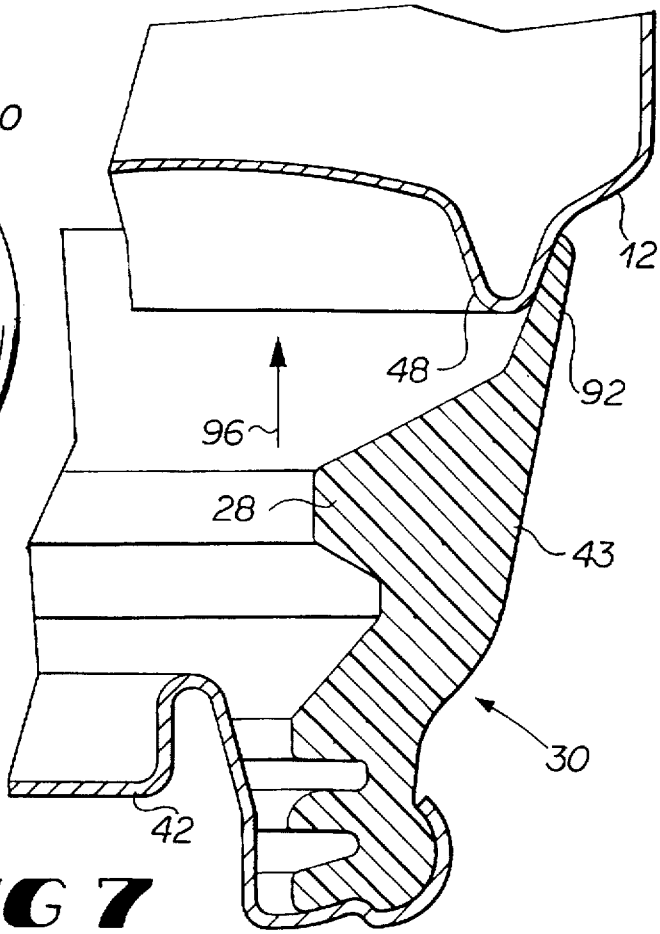
FIG. 7 is a side sectional view of the first embodiment of the lid assembly of the present invention used as a coaster on the bottom of a can body.
Figure 5:
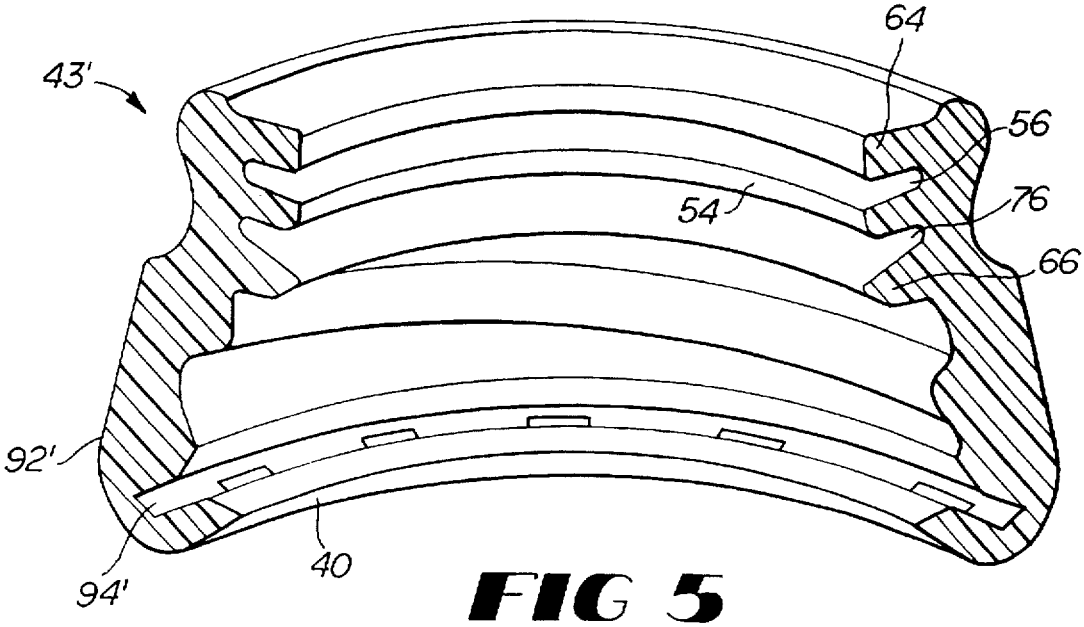
FIG. 5 is a sectional perspective view of a collar used with the second embodiment of the sealing system of the present invention.

Turning now to FIG. 7, lid assembly 30 of the first embodiment used as a coaster is shown. In particular, the skirt 92 of the lid assembly 30 can be received on the ridge 48 on the bottom of the can body 12. FIG. 6 shows this annular ridge 48 around the closed end 16 of the can body 12. Ridge 48 forms a receptacle 50 for receiving the lid assembly 30.

As indicated by arrow 96 in FIG. 7, the lid assembly 30 can merely be forced onto the ridge 48. Because the collar 43 is plastic, it can easily deformed when being received on the ridge 48. The continuous peripheral skirt 92 encircles the ridge 48. Alternatively, the dimensions of the ridge 48 and skirt 92 can be such that the skirt is received within the confines of ridge 48. While the lid assembly 30 of the first embodiment is shown in FIG. 7, it should be appreciated that the lid assembly 30' of the second embodiment can similarly be used as a coaster. This second embodiment of the lid assembly 30' will be described in more detail below.

When the lid assemblies 30 or 30' are placed on the can body 12, a unitary construction is obtained. There are no longer two separate items but one item. Therefore, when disposing of the used can body 12, the lid assemblies 30 or 30' can simultaneously be disposed of. This helps to reduce the potential for litter. Also, by inserting the lid assemblies 30 or 30' onto the closed end 16 of the container, these lid assemblies can act as a coaster.

Returning to FIG. 3, the lid 42 of lid assembly 30 of the first embodiment includes a peripheral groove 98. Tapered guide surface 100 is provided on this lid 42. When the lid assembly 30 is inserted onto the open end 14 of the can body 12, this tapered guide surface 100 will aid in aligning the lid assembly 30 with the can body 12. The tapered guide surface 100 has a camming effect. The tapered guide surface 100 not only helps the manufacturer but it also aids consumers in resealing the can body 12.

In particular, after the lid assembly 30 is removed from the can body 12, it can be again positioned on the can body. Therefore, when a consumer wants to remove the lid assembly 30, it is simply necessary for him or her to unscrew and pull off the lid assembly 30. The lid assembly 30 can then be shoved back on to the can body 12 and screwed into position. The interlocking fingers 28 and lugs 24 will hold the lid assembly 30 in position. The inner protrusion 66 helps to protect the means for sealing 52 from being damaged during mounting or removal of lid assembly 30. The deformable lip 54 can repeatedly form a hermetic seal 74. When gas from the contents of can body 12 escape as indicated by arrow 90, the lip 54 can again deform to ensure that this gas will not leave the can.

The lid assembly 30 or 30' can be resealed on can body 12 even after it has been used as a coaster. It is relatively easy to remove the lid assembly 30 or 30' from the receptacle 50 and then to reapply the lid assemblies 30 or 30' at the open end 14 of the can body 12. Of course, after the bridges 94 are broken, it is not possible for a consumer to reattach the skirt 92 to the tamper evident ring. This provides for a tamper evident feature for the sealing system of the present invention.

The skirt 92 has an outermost circumference which is less than or equal to the largest outermost circumference of the can body 12. In other words, the lid assembly 30 remains within boundary 106. Therefore, the overall circumference of the assembled sealing system 10 does not enlarge the size of the can. Because the lid 42 is in direct engagement with the flange 88 of can body 12, the overall height of the assembled can is the same as a "standard" can. In other words, existing cans are a given height which is the same as the can bodies 12 which use the instant sealing system 10. Therefore, this sealing system 10 can be used without modification to existing vending machines. Current storage requirements for filled cans are not changed when using the instant sealing system 10. Major modifications to existing can stock and machinery for manufacturing cans is not needed when using the instant sealing system.

Figure 4:
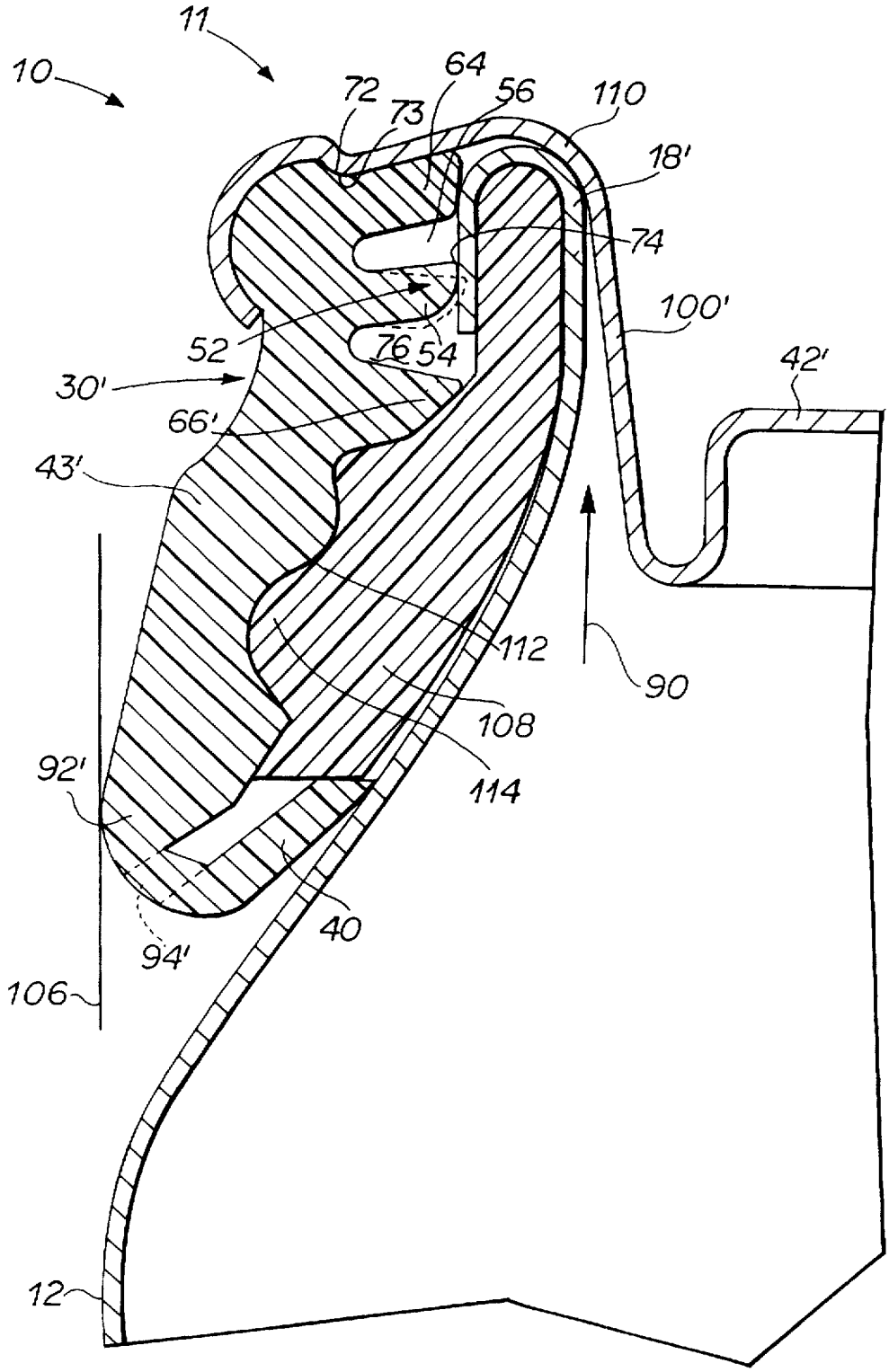
FIG. 4 is a sectional side view of a second embodiment of the sealing system of the present invention.

Turning now to FIG. 4, a second embodiment of the lid assembly 30' will now be described. In this embodiment, an intermediate member 108 is used. It is contemplated that this intermediate member 108 as well as the collar 43' will be made from plastic material. The lid 42' will be made from metal. This lid 42' is similar to the lid 42 except that the slope of the tapered guide surface 100' is continuous to the upper curved portion 110 of lid 42'. Of course, it is possible for the same lid 42 of the first embodiment to be used with the lid assembly 30' of the second embodiment.

Instead of a double rolled flange 18, the second embodiment has a bent flange 18'. The intermediate member 108 is mounted on this flange 18'. The flange 18' can be crimped and/or adhesively bonded to the intermediate member 108. It is contemplated that the intermediate member 108 will remain with the can body 12 when the lid assembly 30' is removed. This lid assembly 30' includes threads 112 on collar 43'. The intermediate member 108 also has threads 114. In this matter, it is possible to simply unscrew the lid 42' from the intermediate member 108 and the can body 12. Of course, an unscrewing and pulling arrangement can be used with the second embodiment similarly to the first embodiment.

On the lid 42' of the second embodiment, means for sealing 52 include the deformable sealing lip 54 and the annular chamber 56. This means for sealing 52 in the second embodiment is the same as that of the first embodiment.

An axially outer protrusion 64 and an axially inner protrusion 66' are also provided in the second lid assembly 30'. These protrusions function in the same way as the protrusions of the first embodiment. The difference between the axially inner protrusion 66' of the second embodiment and the axially inner protrusion 66 of the first embodiment is that the straight tapered surface 80 of the first embodiment is omitted. Rather, a contour which follows the threads of the intermediate member 108 can be provided. Alternatively, a straight tapered surface 80 as used in the first embodiment could be used in the second embodiment if so desired.

The means for sealing 52 provides a hermetic seal 74 between the collar 43' and the flange 18'. A permanent hermetic seal 72 is provided between the lid 42' and the collar 30' similar to the first embodiment. This seal 72 can be made by adhesives 73 and/or crimping between lid 42' and collar 30'.

Gas escaping from the interior of can body 12 as indicated by arrow 90 can leak past the surface 100' of lid 42' and the flange 18' if pressures with can body 12 are sufficiently high. The seal 72 between the lid 42' and the collar 43' will prevent gas from escaping. As gas escapes from the can body 12, the pressure within the annular chamber 56 will increase similarly to the first embodiment. This will cause the sealing lip 54 to deform. The sealing lip 54 engages flange 18' to form the hermetic seal 74. As pressure within annular chamber 56 increases, the hermetic seal between lip 54 and flange 18' increases. Accordingly, as in the first embodiment, a seal can assuredly be obtained with the second embodiment of the sealing system of the present invention.

At the lower end of collar 43' is a pilfer-proof or tamper evident ring 40. The bridges 94' connecting the tamper evident ring 40 to skirt 92' are configured differently in the second embodiment. A plurality of bridges 94' or a single, continuous frangible bridge can be used between skirt 92 and tamper evident ring 40. The bridges 94' will rupture similarly to the first embodiment such that the tamper evident ring 40 will remain on the can body 12 when the lid assembly 42' is removed therefrom. The tamper evident ring 40 engages the intermediate member 108 in the second embodiment instead of a ring receiving ridge 34 and indentation 32. Therefore, the contour of the can body is easier and less expensive to manufacture in the second embodiment.

While the shape of the skirt 92' in the second embodiment is not as elongated as that of the first embodiment, this skirt remains within the confines of boundary 106. In other words, the lid assembly 30' of the second embodiment will not increase the overall circumference of the area defined by the can body 12. Therefore, this second embodiment can readily be used with existing vending machines and existing materials handling systems and storage devices.

Because the lid 42' of the second embodiment engages the flange 18' directly at area 110, the overall height of the can assembly is not increased. Therefore, the can body having the lid assembly 30' of the second embodiment will have a height similar to a standard, existing can. Again, modifications to vending machines and changes in storage are unnecessary.

Figure 8:
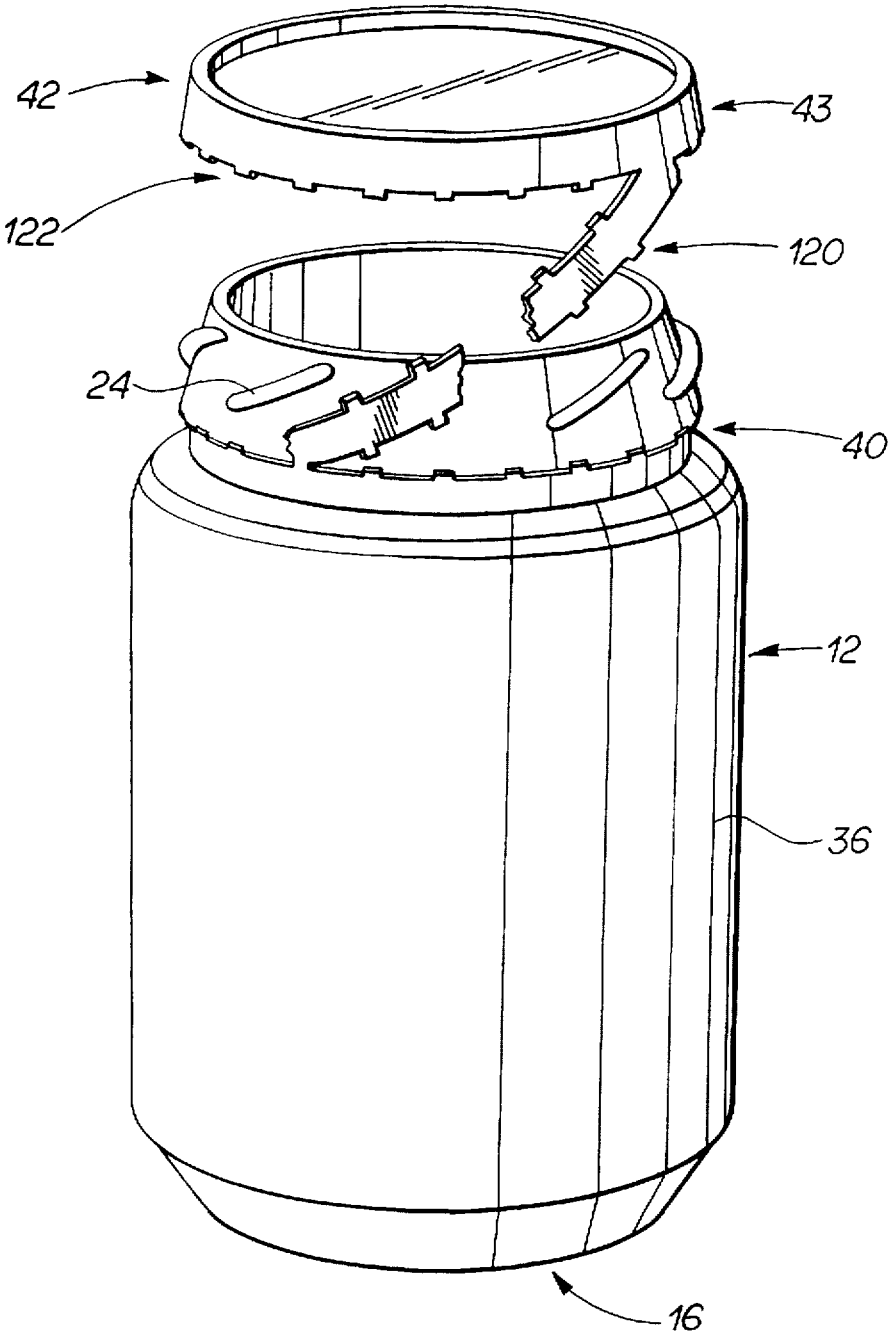
FIG. 8 is a side sectional view of a third embodiment of the sealing system of the present invention.

In FIG. 8, a third embodiment of the sealing system is shown. In this embodiment, a tether 120 extends between the tamper evident ring 40 and the collar 43. While a collar 43 of the first embodiment is noted, it should be appreciated that the third embodiment sealing system could easily be used with either the lid and collar assembly of the first or the second embodiments.

When lid 42 is initially mounted on can body 12, the tamper evident ring 40 is attached to the plastic collar 43 through tether 120. When the lid 42 is unscrewed from the can body, frangible portions or perforations 122 between the ring 40 and collar 43 are broken. The tether then becomes the sole connection between lid 42 and can body 12. This unitary construction aids in reducing potential litter. There are no longer two separate items (a can body and lid), but instead only one item is present. Therefore, disposing of the used can body 12 will simultaneously dispose of the interconnected lid 42.

Of course lid 42 can be screwed back onto the can body. The tether 120 will not interfere with this reclosing of the can opening. However, because the perforations 122 have been broken, it will be readily evident to a consumer that the can has been unsealed.

While FIG. 8 shows lid 42 as being without any openings, it should be appreciated that a conventional "press-down-stay-on tab" or a "ring pull" tab could be used on this lid. Also, a pop-out-spout or other types of easy-open can ends can be used for lid 42.

Accordingly, with the present invention, a twist-off can end assembly 11 is obtained. A cylindrical can body 12 has an open end 14 and closed end 16 which receive a lid assembly 30 or 30'. The lid assembly will close the open end 14 of the can body 12. The lid assembly 42,42' contacts the flange 18,18', respectively. A collar 43,43' is attached to the lid 42,42'. Means 52 are provided for sealing the lid 42,42' to the can body 12. This means 52 includes the deformable sealing lip 54. Increases in pressure within annular chamber 56 adjacent lip 54 will cause this sealing lip 54 to deform. Increased pressure in annular chamber 56 will increase the seal formed by lip 54 and flange 18,18'.

In the present invention, a method is obtained for forming a seal at the end of the can body. This method includes placing a lid assembly 30 or 30' over the open end 14 of the can body 12. The lid 42,42' of the lid assembly 30,30' will engage the flange 18,18'. A hermetic seal will be formed between sealing lip 54 and flange 18,18'. Annular chamber 56 receive gas escaping from the interior of can body 12. This gas will increase the pressure in the annular chamber 56 causing deformation of the sealing lip 54. The hermetic seal 74 formed by lip 54 will increase in response to increasing deformation.

Accordingly, the present invention provides for an automatic sealing system and method which is easy to use. The lid assembly 30,30' can be removed from the can body 12 in order to permit a consumer to drink directly from the can. Also, ice can be easily added to a beverage within the can body 12. Because the collars 43,43' cover areas which will contact the lips of a consumer drinking from the can, the mouth contact area is kept clean. Dirt and other contaminants will not be a problem.

The sealing system 10,10' can be easily placed onto and removed from the can body 12. Consumers can readily reclose a can after its use. Minimum revision to existing can stock is required by this sealing system 10.

Pilfer-proof and tamper evident features are provided with this system 10. Because only two parts are obtained when the lid assembly 30,30' is removed from the can body 12, the potential for litter is reduced. The potential for litter is further reduced because the lid assembly 30,30' can be mounted on the bottom of the can body 12. This feature also provides for a coaster.

The can body 12 and lid assembly 30,30' provide for a relatively strong, sturdy container. The package is relatively resistant to forces including lateral forces when the lid assembly 30,30' is mounted on the can body 12. Both of lid assemblies 30 and 30' can be nested when stacked. Therefore, minimum space is required for packaging and handling these lid assemblies.

Because the lid assemblies can be removed from the container body 12, it is possible to include hidden gifts and other promotional materials within the can body 12. This provides a significant promotional advantage in the marketplace compared with current can-ends.

If a "ring-pull" or "press-down-stay-on-tab" or any other sealed opening is provided in the lid assembly 30,30', it is possible for the user to drink directly from the can without removing the lid. However, if such an opening is not provided or is not open, the lid assembly 30,30' can be removed and then replaced. It is therefore possible to reseal the can, if desired. Of course, with the lid assembly 30,30' remaining in place, the consumer can open the pull-tab, if provided and drink from the can in the usual manner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A twist-off can end assembly, comprising:

a cylindrical can body having an open end and a closed end with a flange extending around the can body at the open end thereof; and a lid assembly for closing the open end of the can body, the lid assembly including, a lid, the lid being adjacent to the flange when the open end of the can body is closed by the lid assembly, and a collar attached to the lid, the collar having means for sealing the lid assembly to the can body, the means for sealing comprising a deformable sealing lip engageable with the can body to thereby form a hermetic seal when the lid assembly is placed on the can body, an annular chamber being defined between the collar and the can body, the annular chamber being adjacent the sealing lip, pressure within the annular chamber increasing due to increases in pressure of contents within the can body, the sealing lip being deformable in response to increases in pressure within the annular chamber, and the hermetic seal between the lid assembly and the can body increasing in response to increasing deformation of the lip.

2. The twist-off can end assembly according to claim 1, wherein the collar is rigidly and hermetically sealed to the lid, adhesive being applied between the collar and the lid and a portion of the lid enclosing a portion of the collar.

3. The twist-off can end assembly according to claim 1, wherein the collar is plastic and the lid is metal and wherein the sealing lip of the collar engages the flange of the can body when the lid assembly is mounted on the can body.

4. The twist-off can end assembly according to claim 1, wherein the flange on the can body has a first outer circumference and wherein the sealing lip has a sealing tip engageable with the flange, the sealing tip having a second circumference when the sealing lip is undeformed, the first circumference being greater than the second circumference.

5. The twist-off can end assembly according to claim 1, wherein the collar has an axially outer protrusion, the axially outer protrusion being adjacent the lid and defining a portion of the annular chamber, the axially outer protrusion being adjacent the flange of the can body when the lid assembly is mounted thereon.

6. The twist-off can end assembly according to claim 5, wherein the collar has an axially inner protrusion, an annular groove being defined by the sealing lip and the axially inner protrusion, the sealing lip being deformable to decrease a size of the annular groove while increasing a size of the annular chamber in response to increases in pressure in the annular chamber, the sealing lip being located between the axially outer protrusion and the axially inner protrusion.

7. The twist-off can end assembly according to claim 1, wherein the collar has an axially inner protrusion, an annular groove being defined by the sealing lip and the axially inner protrusion, the sealing lip being deformable to decrease a size of the annular groove while increasing a size of the annular chamber in response to increases in pressure in the annular chamber.

8. The twist-off can end assembly according to claim 7, wherein the axially inner protrusion has a flat radially inner edge, the flat edge being engageable with the flange of the can body when the lid assembly is mounted on the can body to thereby support the open end of the can body.

9. The twist-off can end assembly according to claim 7, wherein the axially inner protrusion is tapered on a side opposite to the annular groove, the collar being guided by tapering of the axially inner protrusion during insertion of the lid assembly onto the open end of the can body.

10. The twist-off can end assembly according to claim 1, wherein mating surfaces are provided on the collar and can body such that the lid can be screwed onto and off of the can body.

11. The twist-off can end assembly according to claim 1, wherein the collar includes a plurality of can mating fingers, the fingers being positioned around an interior of the collar, the fingers being distally located from an end of the collar attached to the lid, and wherein the can body includes a plurality of lugs for mating with the fingers and locking the lid assembly on the can body.

12. The twist-off can end assembly according to claim 11, wherein the fingers and the lugs are in a matching orientation, and wherein a plurality of openings are provided between the fingers and between the lugs, the fingers moving past the lugs through the openings during mounting of the lid assembly on the can body whereafter the lid assembly is twisted to engage the fingers with the lugs and to slide a mating surface of the fingers against a mating surface of the lugs whereby the lid assembly is locked onto the can body.

13. The twist-off can end assembly according to claim 12, wherein an axially inner protrusion is provided on the collar, the axially inner protrusion being located between the fingers and the sealing lip, the axially inner protrusion having a flat radially inner edge, the flat radially inner edge being engageable with the flange of the can body when the lid assembly is mounted on the can body to thereby support the open end of the can body.

14. The twist-off can end assembly according to claim 13, wherein an inner protrusion circumference is defined by the flat edge of the axially inner protrusion and wherein a lug circumference is defined around the can body by radially innermost ends of the lugs, the inner protrusion circumference being less than the lug circumference and the lug circumference being greater than an outer circumference of the flange.

15. The twist-off can end assembly according to claim 13, wherein the collar further includes a depending peripheral skirt and a tamper evident ring, the collar being attached to the lid at a first end and the skirt being attached to a second end of the collar, the first and second ends being opposed ends of the collar and the tamper evident ring being detachably secured to a bottom end of the skirt, the fingers being located between the tamper evident ring and the inner protrusion.

16. The twist-off can end assembly according to claim 1, further comprising a tamper evident ring and a tether, the tamper evident ring being mounted around the open end of the can body and the tether extending between the tamper evident ring and the lid.

17. The twist-off can end assembly according to claim 16, wherein the tether is mounted to the collar and further comprising frangible portions between the collar and tether and between the tether and tamper evident ring, when the lid is initially removed from the can body, the frangible portions being broken.

18. The twist-off can end assembly according to claim 1, further comprising a tamper evident ring, the collar having a depending peripheral skirt at an end opposite the lid, the skirt having a bottom end and the tamper evident ring being detachably secured to the bottom end of the skirt.

19. The twist-off can end assembly according to claim 18, further comprising bridges provided between the tamper evident ring and the skirt, the bridges breaking when the tamper evident ring is detached from the skirt, the lid assembly being removable from the can body upon breaking of the bridges, the tamper evident ring remaining on the can body after the lid and collar are removed therefrom.

20. The twist-off can end assembly according to claim 19, wherein the seal between the lid assembly and the can body is broken when the lid assembly is removed from the can body, the can body further including a receptacle for receiving the lid assembly after the seal is broken, the receptacle being located at an outer side of the closed end of the can body, the lid assembly being held on the can body when positioned in the receptacle to thereby form a coaster.

21. The twist-off can end assembly according to claim 20, wherein at least a portion of the bridges remain on the skirt when the seal is broken, the lid assembly being mounted to the receptacle through the portion of the bridges remaining on the skirt, the receptacle including a ridge on the closed end of the can body, the portion of the bridges remaining on the skirt being engageable with the ridge.

22. The twist-off can end assembly according to claim 1, further comprising a receptacle on the closed end of the can body, the lid assembly being held by the receptacle when the lid assembly is removed from the open end of the can body to thereby form a coaster.

23. The twist-off can end assembly according to claim 22, wherein the receptacle is an annular ridge provided on the closed end of the can body.

24. The twist-off can end assembly according to claim 1, wherein the lid has an annular tapered surface for guiding the lid assembly onto the open end of the can body, the lid further having a straight wall adjacent the annular tapered surface, the straight wall contacting the flange when the lid assembly is mounted on the can body to support the open end of the can body.

25. The twist-off can end assembly according to claim 1, further comprising a pull-tab mounted on the lid.

26. The twist-off can end assembly according to claim 1, wherein the flange of the can body is rolled to have a downwardly extending portion and an upwardly extending portion, the upwardly and downwardly extending portions abutting one another around a circumference of the open end of the can body with the upwardly extending portion being between the downwardly extruding portion and the can body.

27. The twist-off can end assembly according to claim 1, further comprising an intermediate member, the intermediate member being mounted to the can body by the flange, the intermediate member surrounding the can body at the open end thereof, the intermediate member being engaged by the lid assembly when the lid assembly is mounted on the can body.

28. The twist-off can end assembly according to claim 27, wherein the intermediate member remains on the can body when the lid assembly is removed therefrom, the intermediate member having means for mounting the lid assembly thereon.

29. The twist-off can end assembly according to claim 28, wherein the means for mounting include threads provided on the intermediate member, the collar having corresponding threads whereby the lid assembly is screwable onto the intermediate member.

30. The twist-off can end assembly according to claim 29, wherein an axially inner protrusion is provided on the collar, an annular groove being defined by the sealing lip and the axially inner protrusion, the sealing lip being deformable to decrease a size of the annular groove while increasing a size of the annular chamber in response to increases in pressure in the annular chamber, the axially inner protrusion being located between the threads on the collar and the sealing lip, the axially inner protrusion being tapered on a side opposite the annular groove, the collar being guided by tapering of the axially inner protrusion during insertion of the lid assembly onto the open end of the can body.

31. The twist-off can end assembly according to claim 27, wherein the intermediate member is plastic and has an annular shape.

32. A sealing member for a can body, the sealing member being mountable on the can body in order to close an opening in the can body, the can body being pressurized by gas contained therein and the sealing member comprising:

a lid; and a collar rigidly attached to the lid, the collar defining a portion of a chamber, the chamber receiving escaping gas whereby pressure within the chamber increases, the collar further having sealing means forming a hermetic seal between the sealing member and can body, the sealing means increasing the seal in response to increases in pressure in the chamber, wherein the collar is rigidly and hermetically sealed to the lid, adhesive being applied between the collar and the lid and a portion of the lid enclosing a portion of the collar.

33. The sealing member according to claim 32, further comprising an intermediate member, the intermediate member being engageable by the lid assembly, being plastic and having an annular shape.

34. The sealing member according to claim 32, wherein the collar is plastic and the lid is metal and wherein the sealing means comprises a sealing lip on the collar, the chamber being an annular chamber surrounded by the sealing lip, the sealing lip being deformable in response to increases in pressure in the chamber.

35. The sealing member according to claim 34, wherein the collar has an axially outer protrusion, the axially outer protrusion being adjacent the lid and defining a portion of the annular chamber.

36. The sealing member according to claim 35, wherein the collar has an inner protrusion, an axially annular groove being defined by the sealing lip and the axially inner protrusion, the sealing lip being deformable to decrease size of the annular groove while increasing size of the annular chamber in response to increases in pressure in the annular chamber, the sealing lip being located between the axially outer protrusion and the axially inner protrusion.

37. The sealing member according to claim 32, wherein the collar has an axially inner protrusion, a groove being defined by the sealing lip and the axially inner protrusion, the sealing lip being deformable to decrease size of the groove while increasing size of the chamber in response to increases in pressure in the chamber.

38. The sealing member according to claim 32, further comprising a tamper evident ring, the collar having a depending peripheral skirt at an end opposite the lid, the skirt having a bottom end and the tamper evident ring being detachably secured to the bottom end of the skirt.

39. The sealing member according to claim 38, further comprising bridges provided between the tamper evident ring and the skirt, the bridges breaking when the tamper evident ring is detached from the skirt.

40. The sealing member according to claim 32, further comprising a tamper evident ring and tether, the tether extending between the collar and the tamper evident ring and the tamper evident ring being mountable around the opening of the can body.

41. The sealing member according to claim 40, wherein the tether is mounted to the collar and further comprising frangible portions between the collar and tether and between the tether and tamper evident ring, when the lid is initially removed from the can body, the frangible portions being broken.

42. The sealing member according to claim 32, further comprising a pull-tab mounted on the lid.

43. A method for sealing an open end of a can body with a lid assembly, the can body having a closed end opposite the open end thereof, the can body further having a flange extending around the open end, the lid assembly having a lid and collar, the collar being hermetically mounted to the lid and having a sealing lip, the method comprising the steps of:

placing the lid assembly over the open end of the can body;

engaging the lid and the sealing lip with the flange;

forming a hermetic seal between the sealing lip and the flange;

providing an annular chamber defined by the collar and the flange, the annular chamber being adjacent the sealing lip;

receiving gas escaping from an interior of the can body in the annular chamber;

increasing pressure of the annular chamber as gas is received therein;

deforming the sealing lip in response to pressure increase in the annular chamber; and increasing the hermetic seal between the sealing lip and the flange in response to increasing deformation of the sealing lip.

44. The method for sealing according to claim 43, wherein the flange has a first outer circumference and wherein the sealing lip has a sealing tip engageable with the flange, the sealing tip having a second circumference when the sealing lip is undeformed, the first circumference being greater that the second circumference, the method further comprising the step of camming the sealing lip onto the flange during placing of the lid assembly over the open end of the can body.

45. The method for sealing according to claim 43, wherein the step of placing the lid assembly over the open end of the can body includes the step of twisting the lid assembly onto the can body.

46. The method for sealing according to claim 43, further comprising the step of providing an intermediate member mounted to the flange of the can body and wherein the step of placing the lid assembly over the open end of the can body includes the step of screwing the lid assembly onto the intermediate member.

* * * * *